US007287484B2

(12) United States Patent
Landry et al.

(10) Patent No.: US 7,287,484 B2
(45) Date of Patent: Oct. 30, 2007

(54) BERTHING METHOD AND SYSTEM

(76) Inventors: David Charles Landry, 355 Black River Dr., Madisonville, LA (US) 70447; William Thomas Bennett, Jr., 301 Avenue E., Metairie, LA (US) 70005

( * ) Notice: Subject to any disclaimer, the term of this patent is extended or adjusted under 35 U.S.C. 154(b) by 0 days.

(21) Appl. No.: 10/834,179

(22) Filed: Apr. 29, 2004

(65) Prior Publication Data

US 2004/0216485 A1 Nov. 4, 2004

Related U.S. Application Data

(60) Provisional application No. 60/468,137, filed on May 1, 2003.

(51) Int. Cl.

| | |
|---|---|
| ***B63B 21/00*** | (2006.01) |
| ***B63B 21/50*** | (2006.01) |
| ***B63B 22/02*** | (2006.01) |
| ***E02B 3/20*** | (2006.01) |
| ***E02B 3/26*** | (2006.01) |

(52) U.S. Cl. ..... 114/230.1; 114/230.2; 114/293; 114/219; 441/3; 405/212

(58) Field of Classification Search ..... 114/219, 114/220, 293, 230.1, 230.13, 230.14, 230.15, 114/230.2, 263–267; 441/3–5; 405/195.1, 405/212–216, 218–221, 223.1–224.4; 414/137.1, 414/137.5, 138.4

See application file for complete search history.

(56) References Cited

U.S. PATENT DOCUMENTS 2,120,545 A * 6/1938 Buckton ..... 114/219
2,759,331 A * 8/1956 Fiebinger et al. ..... 405/219
2,921,442 A * 1/1960 Laborde et al. ..... 405/207
3,479,673 A * 11/1969 Manning ..... 114/264
3,516,259 A * 6/1970 Tokola ..... 405/208
3,552,131 A * 1/1971 Mott et al. ..... 405/210
3,713,415 A * 1/1973 Arita et al. ..... 114/230.1
3,765,463 A * 10/1973 Gassett et al. ..... 141/388
3,916,812 A * 11/1975 Bartels ..... 114/230.15
4,150,636 A * 4/1979 Lundh ..... 114/230.1
4,156,577 A * 5/1979 McMakin ..... 405/196

(Continued)

FOREIGN PATENT DOCUMENTS

EP 1400442 A1 * 3/2004

(Continued)

*Primary Examiner*—Ajay Vasudeva
(74) *Attorney, Agent, or Firm*—Jones, Walker, Waechter, Poitevent, Carrere & Denegre, L.L.P.

(57) ABSTRACT

A method and a system are provided for the safe berthing of marine vessels in the high seas and other unprotected open waters. The invention allows a large vessel to be berthed alongside in close enough proximity to a marine structure so that conventional loading arm equipment may be used to load and unload the vessel under most environmental conditions. One or more floating dolphins moored to the bottom of the sea and provided with fendering means are used for berthing the vessel alongside to the marine structure. The preferred type of floating dolphin is a triangular semi-submersible moored buoyant structure comprising three buoyant column members, or "caissons", arranged invertical fashion, three buoyant hull segments, or "pontoons", that support and separate the column members and provide heave damping to the moored buoyant structure, and three horizontal bracing members that retain the tops of the column members in place.

18 Claims, 8 Drawing Sheets

U.S. PATENT DOCUMENTS

| | | | | | |
|---|---|---|---|---|---|
| 4,168,673 | A | | 9/1979 | Poeppel | |
| 4,317,474 | A | | 3/1982 | Kentosh | |
| 4,331,097 | A | * | 5/1982 | Belinsky | 114/230.15 |
| 4,359,011 | A | * | 11/1982 | Lyles | 114/230.19 |
| 4,446,807 | A | * | 5/1984 | Johnson et al. | 114/230.23 |
| 4,556,341 | A | * | 12/1985 | Ayers | 405/195.1 |
| 4,646,672 | A | | 3/1987 | Bennett et al. | |
| 4,864,958 | A | * | 9/1989 | Belinsky | 114/265 |
| 4,883,013 | A | * | 11/1989 | Lin | 114/219 |
| 5,092,712 | A | | 3/1992 | Goldman et al. | |
| 5,190,411 | A | * | 3/1993 | Huete et al. | 405/223.1 |
| 6,190,089 | B1 | | 2/2001 | Bennett et al. | |
| 6,390,008 | B1 | * | 5/2002 | Beato et al. | 114/230.2 |
| 6,434,948 | B1 | | 8/2002 | Eide et al. | |
| 2002/0174662 | A1 | | 11/2002 | Frimm et al. | |

FOREIGN PATENT DOCUMENTS

| | | | | |
|---|---|---|---|---|
| EP | 1462358 | A1 | * | 9/2004 |
| FR | 2579558 | A1 | * | 10/1986 |
| GB | 2024292 | A | * | 1/1980 |
| GB | 2096963 | A | * | 10/1982 |
| JP | 52037395 | A | * | 3/1977 |
| JP | 57070790 | A | * | 5/1982 |
| JP | 57180712 | A | * | 11/1982 |
| JP | 11034971 | A | * | 2/1999 |
| JP | 11268684 | A | * | 10/1999 |
| WO | WO 8201859 | A | * | 6/1982 |

* cited by examiner (PRIOR ART)

BERTHING METHOD AND SYSTEM

This application is a non-provisional application for patent entitled to a filing date and claiming the benefit of earlier-filed Provisional Application for Patent No. 60/468,137, filed on May 1, 2003 under 37 CFR 1.53 (c).

FIELD OF THE INVENTION

This invention relates to a method and system for the berthing of marine vessels in open waters. Particularly, this invention relates to the berthing of marine vessels in open waters in spatial relationship to fixed structures. More particularly, the invention relates to a method and system for the berthing of ships in spatial relationship to deepwater port terminals and similar offshore structures. Specifically, the invention relates to a novel technique for berthing of large vessels in spatial relationship to terminals and similar platforms and structures that stand fixed in unprotected waters, such as the open waters of the Gulf of Mexico. The invention is also further applicable to berthing ships that carry liquefied natural gas and other cargoes to deepwater offshore terminals, which terminals may be further equipped for storage on and/or further processing of said cargoes and for distribution from such deepwater offshore terminals.

BACKGROUND OF THE INVENTION

Conventional berthing methods and systems used in most port terminals usually involve the use of a dock, or wharf, fixed to the bottom and provided with fendering means designed to absorb the environmental loads to which the dock is subjected as a result of wind forces, currents and waves. For large vessels, like the ones that transport petroleum products and other specialized products such as liquefied natural gas and compressed natural gas, berthing dolphins are often placed adjacent to or separately from the dock in order to provide additional stability to the ship. Berthing dolphins are freestanding marine structures embedded into the bottom and provided with fendering means for absorbing environmental loads during berthing. Hawsers and similar types of cables and ropes are passed through hawseholes located in the bow of the ship and fastened so as to moor the ship to the dock and hold the ship in proper relationship with the terminal. In these "hard berthing" techniques, the vessel being berthed is made to come into and remain in contact with the fixed marine structures, i.e., the dock terminal and the berthing dolphins.

While these hard berthing techniques may be adequate for loading and unloading cargo to and from wharfs and docks in protected waters, they are not adequate for the loading and unloading of cargoes in unprotected waters during much of the environmental conditions that prevail in such locations. Loading or unloading of cargoes in unprotected waters often requires that the berthing operation be conducted quickly, with minimum separation distance between the vessel and the offshore platform and with high degree of accuracy. Otherwise, the transfer operation runs the risks of causing accidental cargo spills and frozen lines, with their attendant safety and environmental hazards, not to mention expensive product losses.

The use of single-point-mooring buoys is another example of conventional berthing methods and systems. Single-point-mooring buoys, however, are used only at the bow of the vessels, not alongside the vessels, and their use requires that specialized fittings and manifolds be installed on the vessels in order to load and unload the vessels.

It is apparent that a need exists for a technique whereby an offshore structure in unprotected waters, such as a deepwater terminal or platform, is able to receive cargo from large vessels in a safe and efficient manner without substantial periods of shut down due to normal environmental conditions. The present invention is directed toward providing such a technique.

It is an object of the present invention to provide a method and a system for the proper and safe berthing of ships in unprotected waters during most environmental conditions. It is also an object of the present invention to provide a method and a system for berthing marine vessels under ambient conditions that require high degrees of safety, efficiency and effectiveness. Another object of this invention is to provide a commercially practicable method for the berthing of a difficult-to-handle cargo ship alongside in unprotected waters, which method reduces the effects of environmental loads between the ship and the berth while utilizing conventional components in a novel fashion. A specific object of the invention is to provide an environmentally attractive method for berthing large cryogenic-fluid-transport tankers in spatial relationship to offshore platforms and similar structures that serve as deepwater port terminals. A further object of the present invention is to provide a technique that increases the time-available window for berthing a tanker at a fixed structure in open waters in a safe and cost-effective manner. Still a further object of the present invention is to provide a system for berthing vessels alongside in open waters, which system is able to accommodate conventional vessels for loading and unloading and does not require the vessels to have special bow or stern loading manifolds or fittings. These and other objects of the invention will be apparent to those skilled in the art from the description that follows.

SUMMARY OF THE INVENTION

The method and the system of this invention center around the innovative concept of providing one or more floating dolphins, provided with fendering means and placed in a prescribed spatial relationship and orientation with a marine structure, and using such one or more floating dolphins for berthing a vessel alongside in said spatial relationship to the marine structure in open waters. The invention allows a large vessel to be berthed alongside in close enough proximity to the marine structure that conventional loading arm equipment may be used to load and unload the vessel. A floating dolphin is a buoyant structure that is moored to the bottom of the sea. The floating dolphin of this invention is preferably a semi-submersible moored buoyant structure comprising several buoyant column members, arranged in vertical fashion, several buoyant hull segments, or "pontoons", that support and separate the column members and provide heave damping, and several horizontal bracing members that retain the tops of the column members in place. Inside the column members and pontoons, water, or any other kind of liquid or solid ballast material and consumable materials, may be stored in such fashion as to establish the desired draft for the floating dolphin. Preferably, the ballast material is seawater. Attached to the floating dolphin are fendering means, made of a strong impact absorbing material, and so attached to the dolphin structure as to allow it to transfer and absorb the environmental loads resulting from the contacts between the dolphin and the ship. The fendering means may be attached to the column members, to the pontoons, or to both the column members and the pontoons. Preferably, two or more fenders are attached to two of the column members.

In berthing a vessel in accordance with the method of this invention, the vessel is brought into a spatial relationship and orientation in relation to the marine structure so that it is approximately beam on and in line with the fendering means of the floating dolphin, and the lateral side of the vessel and the fendering means of the dolphins are both disposed approximately in the same vertical plane. The hawser/fender system is maintained such that it provides a secure attachment of the floating dolphins and vessel. This attachment permits the dolphins and the vessel to move in concert with each other and dissipate much of the first order wave forces. The responses of the vessel and the dolphins, as well as the stiffness of the mooring and hawser/fender system, must work in harmony to achieve the desired station keeping and load sharing. Since neither the vessel motions nor the sea states can be controlled, the remainder of the system must be tuned for the desired station keeping and load sharing characteristics. The motion characteristics of the floating dolphins must be chosen to complement the vessel motions and to remain coupled with the vessel during first order wave motions, thereby reducing the loads imposed upon the vessel at the hawser/fender connection points.

When operated in the manner prescribed by the method stipulated herein, the berthing system of this invention enables the transfer of many different types of cargo from a vessel to a marine structure in open waters, and vice versa, with minimal delays caused by the influence of winds, waves and currents, and with reduction in the berthing loads between the marine structure and the vessel.

The method of this invention is particularly suited for berthing tankers that transport and unload LNG (liquefied natural gas) and CNG (compressed natural gas); however the method is also suited for berthing ships that transports many other types of cargoes, such as coal, refined and unrefined petroleum crude, certain manufactured goods, etc.

The present invention advances the art of berthing ships alongside in spatial relationship to marine structures, in closed proximity to the marine structures, and under difficult ambient conditions such as those found in unprotected waters, and, in addition, provides an improved method and system for the safe transfer and storage of commercially produced LNG, CNG and other types of cargoes by conventional loading arms with minimal operating and maintenance costs, minimal inventory losses and greatly reduced environmental impact.

BRIEF DESCRIPTION OF THE DRAWINGS

A clear understanding of the key features of the invention summarized above may be had by reference to the appended drawings, which illustrate the method and system of the invention, although it will be understood that such drawings depict preferred embodiments of the invention and, therefore, are not to be considered as limiting its scope with regard to other embodiments which the invention is capable of contemplating. Accordingly.

DETAILED DESCRIPTION OF THE INVENTION

Figure 1:
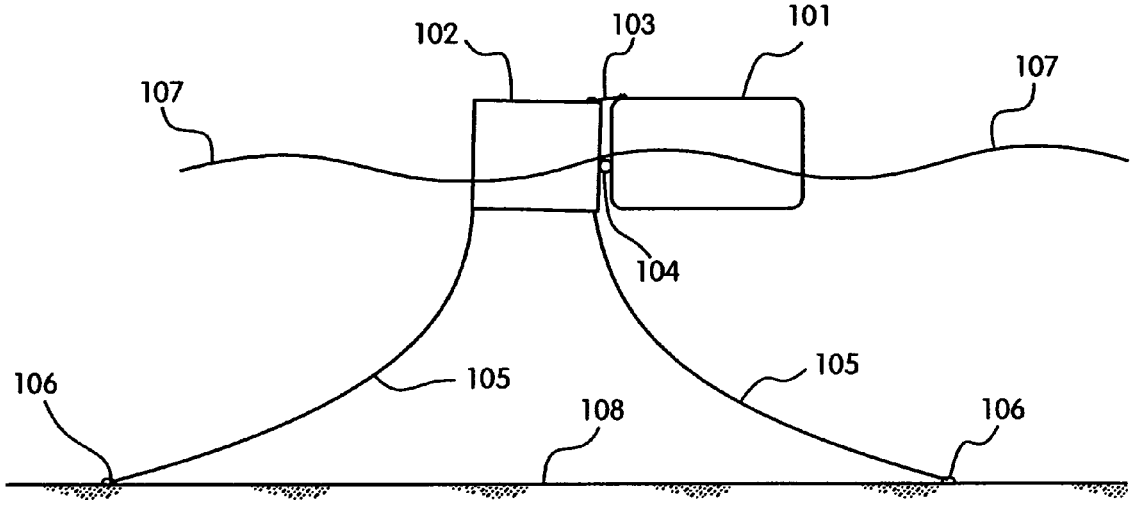
FIG. 1 is an illustration of the method and system of this invention showing a simplified end-view diagram of a vessel that has been berthed alongside using one floating dolphin.

Referring to FIG. 1, vessel 101 is shown berthed by means of floating dolphin 102, which is provided with fendering means 104. Relatively stiff hawser lines 103 provide a secure attachment between floating dolphin 102 and vessel 101 and complement the function of fendering means 104 in permitting the vessel and the dolphin to move in concert with each other and dissipate much of the first order wave forces from water surface 107. Floating dolphin 102 is attached to bottom 108 by means of relatively soft mooring lines 105 and anchors, or piles, 106.

Figure 2:
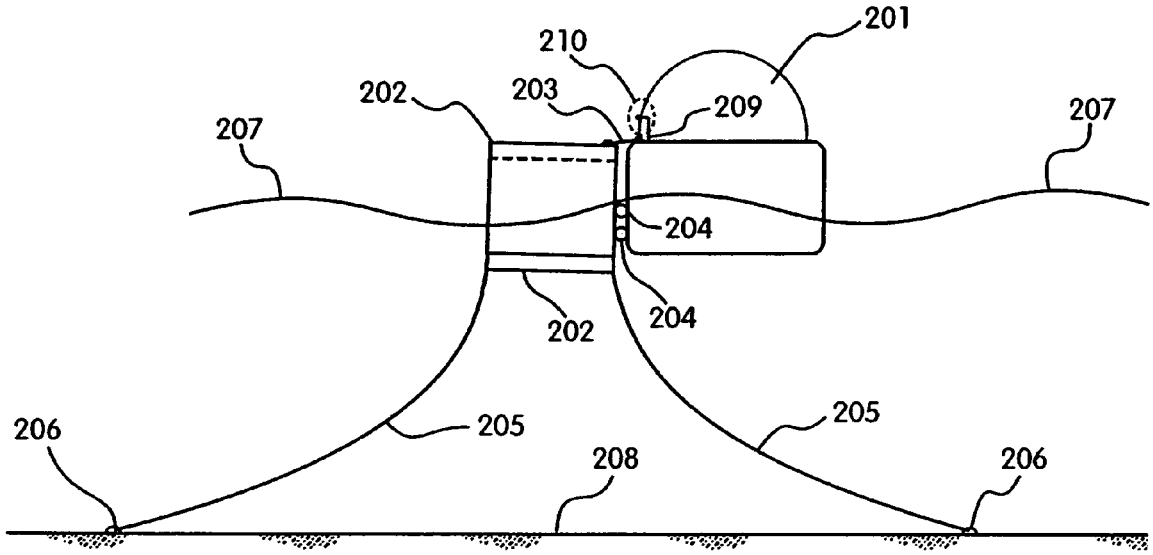
FIG. 2 is an illustration of the method and system of this invention showing a simplified end-view diagram of a large vessel that has been berthed alongside using two floating dolphins.

FIG. 2 depicts the berthing of a large vessel, such as a tanker used to transport LNG, CNG and similar cryogenic fluids, by means of the method of the invention. In this depiction, tanker 201 is shown berthed alongside by means of two floating dolphins 202, provided with fendering means 204. Relatively stiff hawser lines 203 provide a secure way of attaching floating dolphins 202 to tanker 201 and, together with fendering means 204, permit the tanker and the dolphins to move in concert with each other and dissipate first order wave forces on water surface 207. Tanker 201 is provided with cargo transfer manifold 209 for transferring cryogenic fluids and other cargoes to and from marine structures. Watch circle 210 represents an imaginary area in space, fixed relative to the earth, in which the flange of manifold 209 is maintained during the cargo transfer operation when the vessel moves up and down as a result of the environmental loads. Floating dolphins 202 are attached to bottom 208 by means of relatively soft mooring lines 205 and anchors, or piles, 206.

Figure 3:
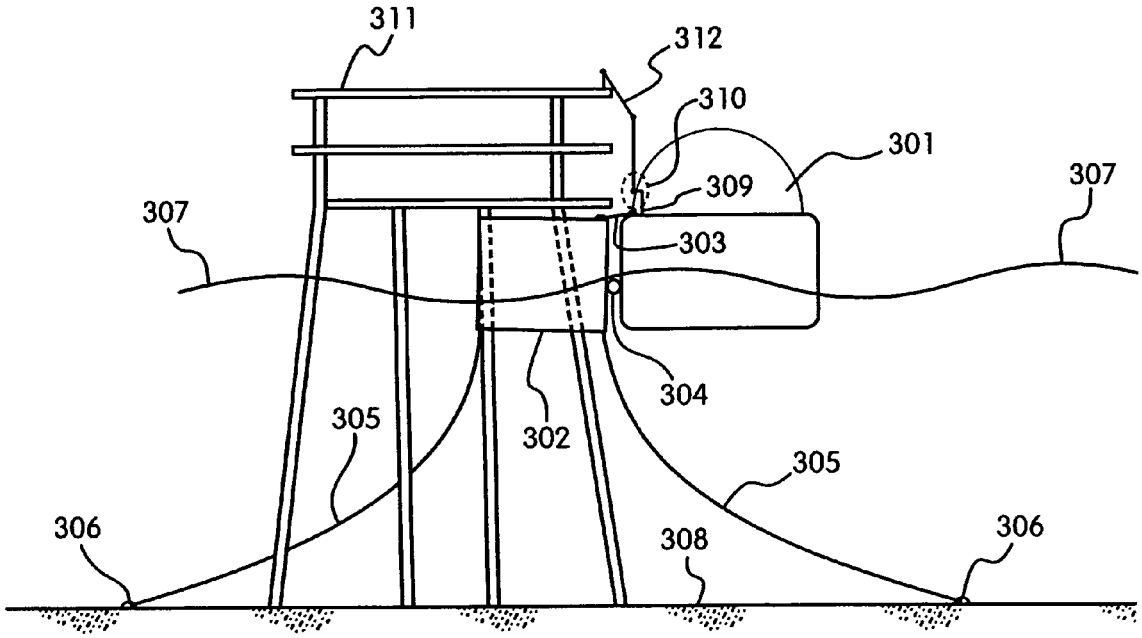
FIG. 3 is an illustration of the method and system of this invention showing a simplified end-view diagram of a cryogenic fluid tanker that has been berthed alongside using two floating dolphins in close proximity to a marine structure, and showing the marine structure.

In FIG. 3, cryogenic fluid tanker 301 is shown berthed alongside by means of floating dolphin 302, near the aft section of tanker 301, and another floating dolphin (not shown), near the fore section of tanker 301, in close proximity with fixed marine structure 311. Tanker 301 is a cargo vessel and, as such, is equipped with cargo transfer piping manifold. Floating dolphin 302 is provided with fendering means 304, made of hard, impact-absorbing rubber, and is attached to bottom 308 by means of relatively soft mooring lines 305 and anchors 306. Relatively stiff hawser lines 303 are employed to attach floating dolphin 302 to tanker 301. The second floating dolphin (not shown) is also provided with similar fendering means and is also moored to the bottom and securely attached to the tanker by means similar to those used on dolphin 302. Tanker 301 is equipped with cargo transfer manifold 309, connectable to loading arms 312, which are attached to fixed marine structure 311. Marine structure 311 is equipped with pivoting means for loading and unloading the cryogenic fluids or other cargoes transported by tanker 301. Such pivoting loading-and-unloading means can be hinged loading arms provided with piping for transferring cargo, or impervious hoses, made of strong materials and capable of rotating, or booms having swivel-jointed cryogenic pipe systems, or any other such similar type of loading-and-unloading equipment conventionally used for handling these cargoes. Watch circle 310 represents an imaginary area in space, fixed relative to the earth, in which the flange of manifold 309 is maintained during the transfer of cryogenic fluids through manifold 309 and loading arms 312 as tanker 301 moves as a result of environmental loads in concert with the floating dolphins, thereby dissipating first order wave forces from water surface 307. The operating envelop of the system depicted in FIG. 3 may depend, at least partly, on the length and flexibility of the loading arms. (The term "operating envelop" is used in the maritime business to denote the distance or radius that a vessel may move up and down, and sideways, as a result of strong environmental forces before the loading arms have to be disconnected from the manifold in order to prevent an accidental spill or other disrupting incident.)

Figure 4:
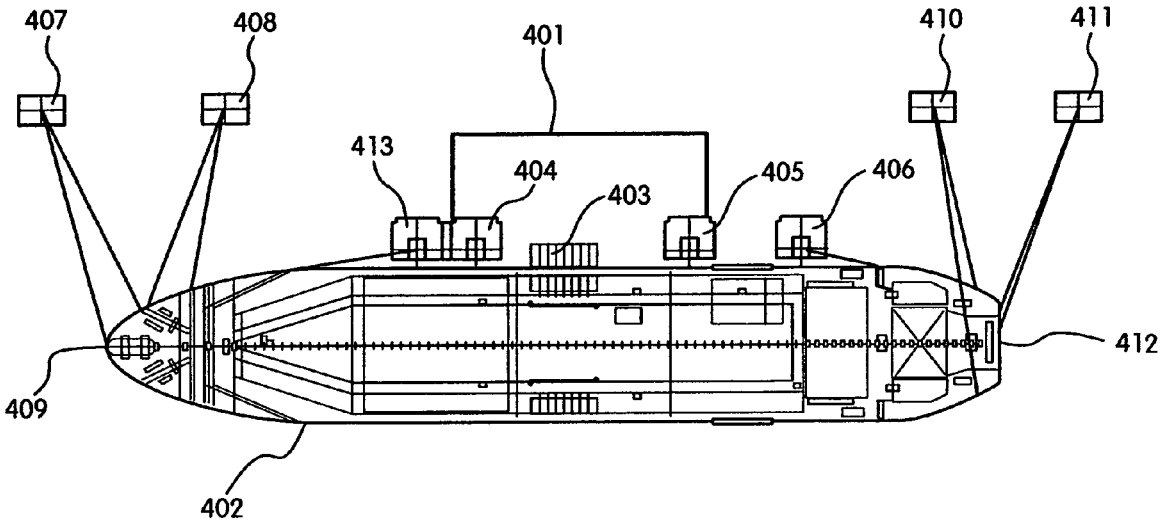
FIG. 4 is a top-view diagram illustrating a conventional manner of berthing a large vessel at a port dock, or wharf, in protected waters, and showing the vessel as berthed.

Referring to FIG. 4, conventional port wharf 401 has been erected in protected waters and is in direct contact with 950-foot-long vessel 402, berthed at the wharf. A fluid cargo, such as crude oil or a cryogenic fluid, is unloaded from vessel 402 onto wharf 401 by a set of conventional swivel loading arms 403, attached to wharf 401. Fenders 404 and 405 are part of wharf 401 and serve to protect the wharf and the vessel during berthing. Fixed berthing dolphin 406, freestanding near the stern of the ship, is equipped with fendering means for absorbing environmental loads during berthing and used to provide additional stability. Fixed mooring dolphins 407 and 408 are tied to vessel 402 at or near bow 409 and are used to moor the vessel. Likewise, fixed mooring dolphins 410 and 411 are tied to vessel 402 at or near stern 412 and are used to moor the vessel. Berthing dolphin 413, fixed to the bottom, is attached to wharf 401 and is used to absorb berthing forces, hold the ship on berth and add stability to the berthing operation. Mooring dolphin 414, fixed to the bottom, is an auxiliary mooring dolphin that is used as needed, depending on vessel size, weather conditions, type of cargo and other such factors. The prior art berthing technique illustrated in FIG. 4 may be adequate for loading and unloading conventional cargo to and from wharfs and dock terminals in protected waters.

Figure 5:
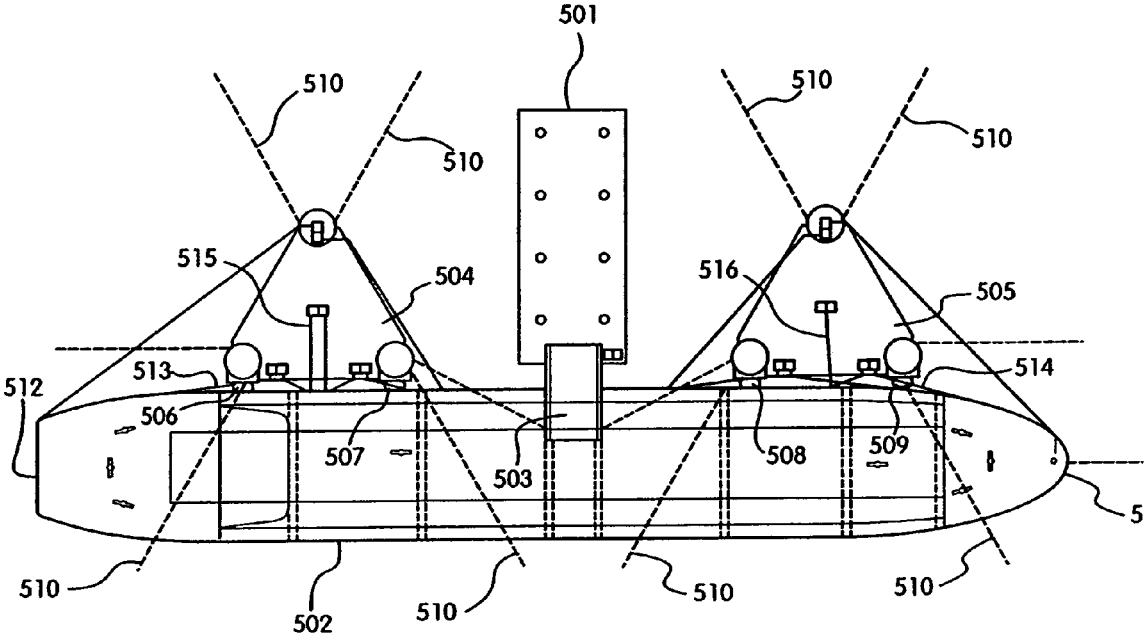
FIG. 5 is a top-view diagram illustrating a preferred embodiment of the method and system of this invention using two of the preferred semi-submersible dolphins that have been placed on each side of an offshore fixed terminal to berth a large vessel at the terminal, and showing the vessel as berthed.

FIG. 5 further illustrates the berthing technique of the method and system of the present invention. Referring to FIG. 5, fixed offshore platform-deck-port terminal 501 has been fabricated and/or installed in unprotected waters, about 200 feet deep, and is not in direct contact with tanker vessel 502, about 950 feet long, berthed alongside at the terminal. (The size of the berthed vessels and the depth of the unprotected waters in which the berthing technique illustrated in FIG. 5 takes place may vary considerably.) Fluid cargo is unloaded from vessel 502 onto terminal 501 through a manifold on vessel 502 and a set of conventional swivel loading arms 503 attached to the terminal. Semi-submersible dolphin 504, moored to the bottom, is one of the semi-submersible buoyant structures, or "floating dolphins", of the invention. Semi-submersible dolphin 504 has been placed on one side of terminal 501, at an appropriate safe distance from that side of the terminal (between about 80 and 100 feet from the closest point on the dolphin) and in such position as to accommodate the aft section of vessel 502 when the vessel arrives. Semi-submersible dolphin 505, moored to the bottom, has been placed on the side of terminal 501 opposite the side where semi-submersible dolphin 504 has been placed, within a safe distance from that side of the terminal (between about 80 and 100 feet from the closest point on the dolphin) and in such position as to accommodate the fore section of vessel 502 when the vessel arrives. Semi-submersible dolphin 504 has fenders 506 and 507 in contact with the aft portside of vessel 502, while semi-submersible dolphin 505 has fenders 508 and 509 in contact with the fore portside of vessel 502. The only movement between the vessel and the dolphin is due to the compressibility of the dolphin fenders, which is approximately 5 feet; and at no time is the terminal in direct contact with the vessel, which is kept at a safe distance of between about 10 and 60 feet from the terminal. (The vessel may also be oriented so that the fenders contact the starboard side of the vessel.) Mooring lines 510 are connected to the fairleaders at the base of semi-submersible dolphins 504 and 505 and are tensioned by means of winches or windlasses (not shown). A system of chain, wire rope and/or synthetic mooring lines is used to moor the dolphins to the seafloor by anchors and/or suction piles (not shown). This mooring system is tuned to be softer than the hawser/fender system such that the environmental loads will be shared in an equitable fashion. Conventional hawser lines, attached to bow 511 and stem 512, may be used to moor vessel 502 to one or more mooring buoys (not shown), if necessary or convenient. Additionally, spring hawser lines 513 and 514 and breasting hawser lines 515 and 516 are used to hold the vessel to the floating dolphins. Optionally, tugboats (not shown) may also be employed to assist with the mooring of the vessel.

Figure 6:
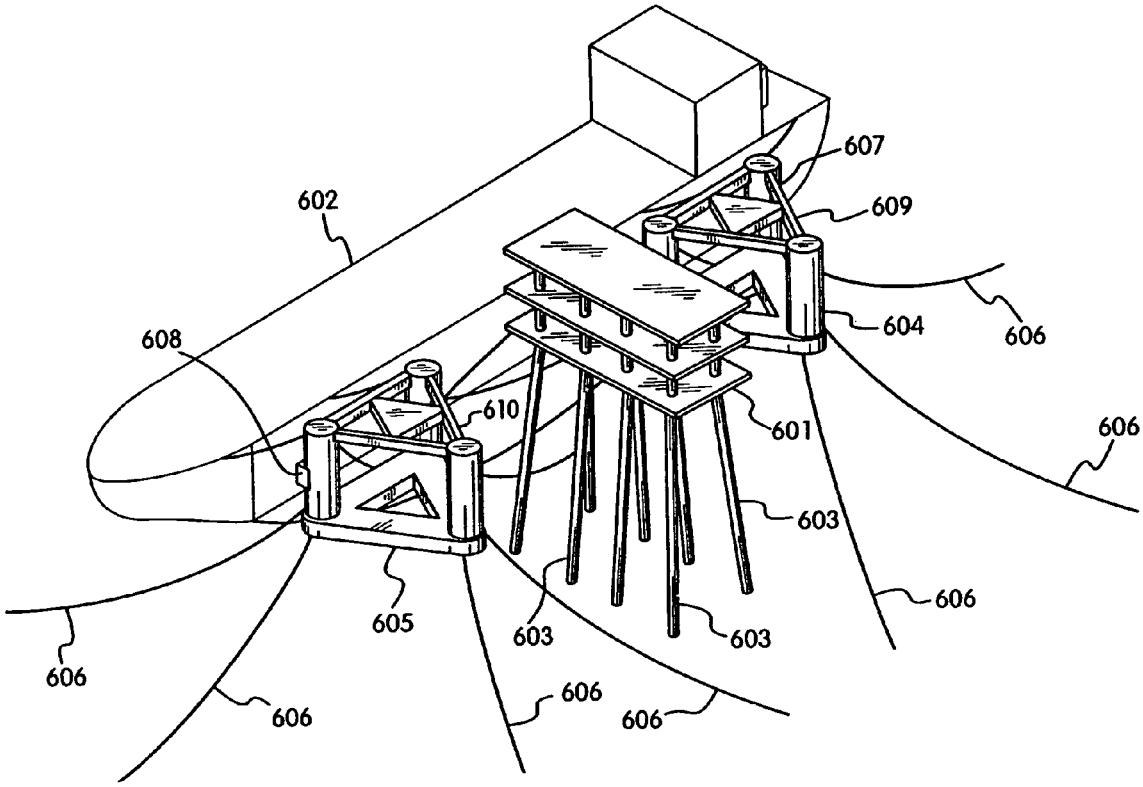
FIG. 6 is a schematic diagram of the preferred embodiment of the invention illustrated in FIG. 5, showing the vessel as berthed.

A schematic diagram of a preferred embodiment of the invention illustrated in FIG. 5 is shown in FIG. 6. Referring to FIG. 6, vessel 602 has been berthed at fixed offshore platform-deck-port terminal 601, which has been erected on seafloor-embedded pilings 603. Tanker vessel 602 has been berthed by means of semi-submersible dolphins 604 and 605, moored to the seafloor by means of mooring lines 606, which are connected to the base of the two dolphins by means of fairleaders (not shown) and tensioned by means of winches or windlasses. Fendering means 607 and 608, on semi-submersible dolphins 604 and 605, respectively, are in contact with vessel 602 and serve to berth the vessel as described above. Tops 609 and 610 of semi-submersible dolphins 604 and 605 may be maintained at approximately the same level as the weather deck of the vessel by controlling the weight of the ballast and consumables inside semi-submersible dolphins 604 and 605. In this manner the desired draft of the floating dolphins may be established. The desired draft of the floating dolphins should be approximately equal to or greater than the draft of the vessels being berthed. This will also result in the mooring lines of the dolphins clearing the keel of the vessels. As may be seen in this illustration, and as is the case in the berthing of vessels afforded by the method and system of this invention, at no time is the terminal in direct contact with the vessel, thus avoiding or minimizing the problems associated with environmental loads and other circumstances attendant to loading and unloading a vessel in open waters.

Figure 7:
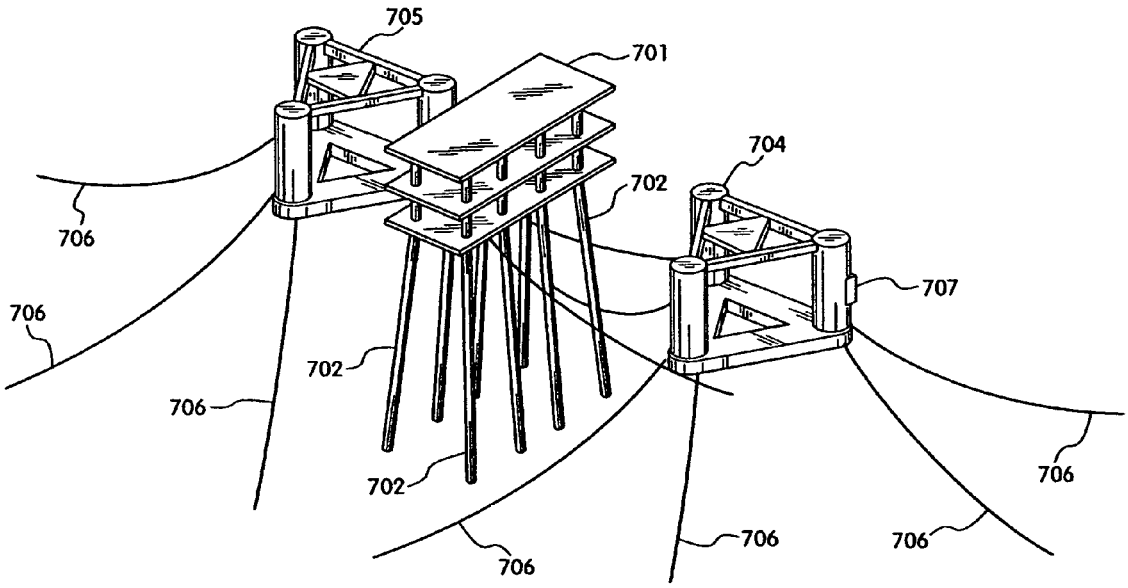
FIG. 7 is a schematic diagram of a preferred embodiment of the method and system of this invention using two triangular semi-submersible dolphins that have been placed on each side of an offshore fixed terminal, before the vessel arrives, in order to berth a large vessel at the terminal.

FIG. 7 is a schematic diagram of a preferred embodiment of the method and system of this invention using two triangular semi-submersible dolphins that have been placed on each side of an offshore fixed terminal, before the vessel arrives, in order to berth a vessel to the terminal. Referring to FIG. 7, fixed offshore platform-deck-port terminal 701, which sits on bottom and is further attached by embedded pilings 702, is flanked by semi-submersible dolphins 704 and 705, moored to the seafloor by means of mooring lines 706, which are connected to the base of the two dolphins by means of fairleaders and tensioned by winches or windlasses (not shown). Fendering means 707, on semi-submersible dolphin 704 and fendering means (not shown) on semi-submersible dolphin 705, serve to absorb vessel berth impact and to act as a buffer between the vessel and the semi-submersible dolphins for transmission of environmental loads. The mooring of semi-submersible dolphins 704 and 705 to the seafloor by means of mooring lines 706 may be accomplished by means of a "catenary mooring" technique or by means of a "semi-taut mooring" technique. In a catenary mooring, a heavy flexible chain, with an appropriate pretension, is used to tie the base of the dolphin to the bottom. The semi-taut mooring is neither a catenary mooring nor a "taut mooring" (where a taut, i.e., tense rigid, cable, with virtually no slack, is used to tie a floating structure to the bottom), but a hybrid concept where elements of both a heavy flexible chain and a tense rigid wire rope or synthetic line are used to moor the dolphin to the anchor or pile embedded in the bottom, e.g., a heavy chain or rope is attached to a rope or cable under tension, which in turn is attached to another piece of chain or rope and so on until they are in turn attached to an anchor or pile.

Figure 8:
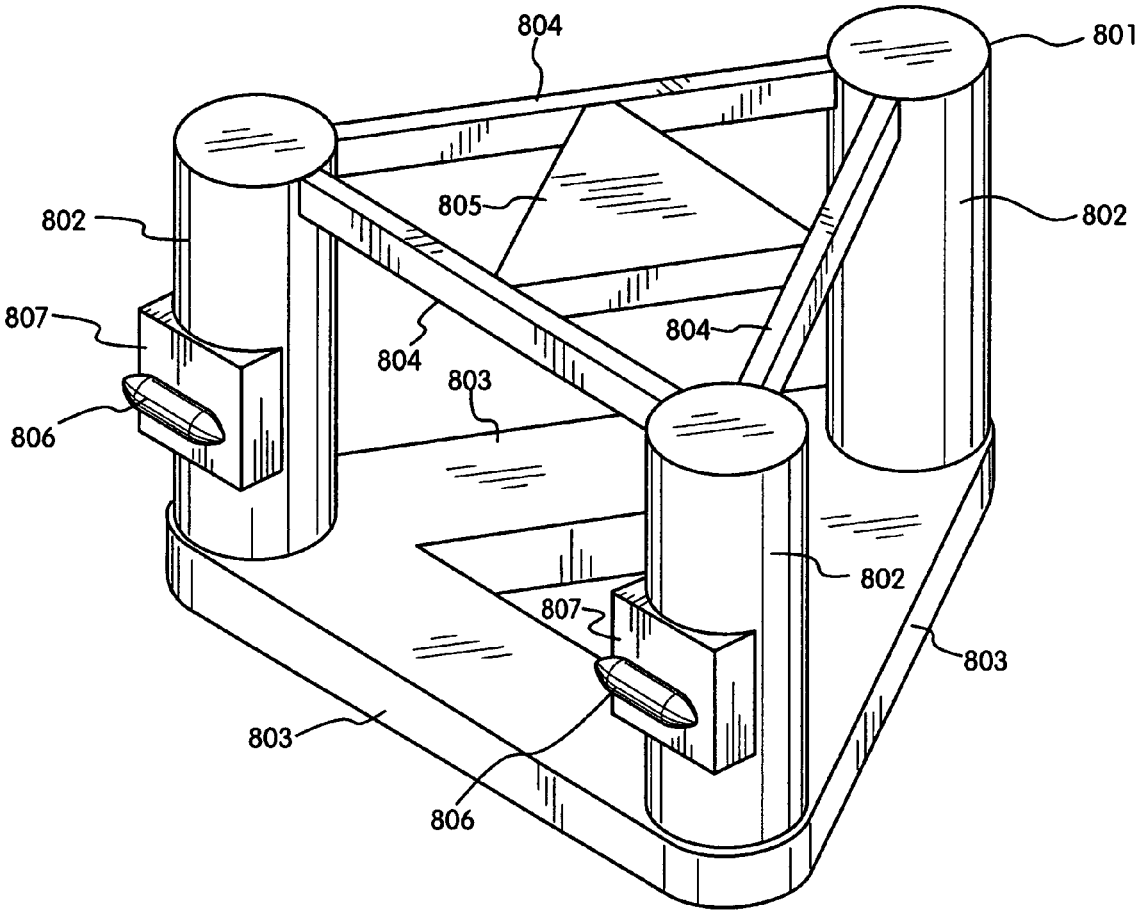
FIG. 8 is a schematic diagram of one of the preferred triangular semi-submersible dolphins prescribed by the method and system of this invention.

FIG. 8 is a schematic diagram of one of the preferred triangular semi-submersible dolphins prescribed by the method and system of this invention. Referring to FIG. 8, triangular semi-submersible dolphin 801 is comprised of three enclosed, hollow buoyant column members, or "caissons", 802, arranged in vertical fashion, three horizontal hull members, or "pontoons", 803 that support and retain the column members in place and provide heave damping, and three horizontal bracing members 804 that retain the tops of the columns in place and support the deck structure. The buoyant column members, or caissons, in this particular embodiment, are about 120 feet high and 32 feet in diameter. The buoyant hull members, or pontoons, in this particular embodiment, are about 140 feet long by 20 feet wide by 14 feet high. The columns and hull members are made of steel and contain enough ballast and/or consumables (not shown) so as to cause the draft of the dolphin to maintain deck means 805 at a proper elevation with respect to the vessel. Preferably, the ballast material is seawater, which is contained in ballast tanks located inside the column and/or hull members and equipped with hoses, pipes and pumping equipment for adding or withdrawing water to the dolphin and thereby control its draft (degree of submersion). Other ballast materials suitable for this purpose include concrete, sand, liquid mud and consumables such as fuel oil, potable water, fresh water, firewater and miscellaneous dry goods and stores. Horizontal bracing members 804 at the top of semi-submersible dolphin 801 have a rectangular shape in this particular embodiment, and are approximately 140 feet long, 4 feet wide and 4 feet high. Attached to triangular semi-submersible dolphin 801 are fendering means 806, made of rubber or some other impact absorbing material and so incorporated into the dolphin structure as to allow it to transfer and absorb the environmental loads resulting from the contacts between the dolphin and the vessel. Steel structural reinforcement 807 is used, in this particular embodiment, to mount fendering means 806 on the dolphin and provide additional strength to the fendering system in order to handle extreme environmental loads. Triangular-shape deck 805 may be conveniently incorporated into the dolphin structure to afford access to it for repairs, maintenance and additional access for berthing operations. The method and the system of this invention then enable the berthing operation to take place in a compliant fashion rather than in a fixed fashion, and this reduces berthing impact forces and results in a safer and more efficient berthing that can maintain the vessel alongside on the berth under more severe environmental conditions than for a fixed berth.

In a preferred embodiment, two semi-submersible dolphins are used, each placed on each side of the terminal or fixed structure at approximately the same distance from the terminal or fixed structure in mirror fashion. This embodiment allows vessels, such as certain large tankers, that have conventional loading-and-unloading manifolds at or near mid-ship to conveniently berth at a location most suitable for the loading-and-unloading operation. Another important feature of this system is that it can accommodate conventional vessels and does not require special bow or stern loading manifolds of fittings. In a preferred embodiment, the column members of the semi-submersible dolphins number three, and are arranged in a substantially equilateral triangular configuration. A triangular configuration provides fabrication cost savings and increased motion stability when the dolphin is subjected to the forces of high winds, waves and currents. More than three column members may be used. The column members are key structural elements of the system of the invention and allow the fendering means to be mounted on the system dolphin. The column members also provide the necessary buoyancy to the dolphin.

The present invention allows the heretofore-impracticable transfer of LNG, CNG and similar cryogenic fluids from large tankers to offshore platforms in unprotected waters. The transfer of such fluids in these environments would entail the use of booms having swivel-jointed cryogenic pipe systems, systems of cryogenic hoses and/or similar cold fluid industrial delivery equipment, which in turn would require that the berthing operation be conducted quickly, with minimum separation distance between the tankers and the offshore platforms and with high degree of accuracy. Otherwise, the transfer operation would run the risks of causing accidental cargo spills and frozen lines, with their attendant safety and environmental hazards, not to mention expensive product losses. The berthing technique of the invention allows the berthing of these tankers to be conducted quickly, with minimum separation distance between the tankers and the offshore platforms and with high degree of accuracy.

While the present invention has been described in terms of particular embodiments and applications, in both summarized and detailed forms, it is not intended that these descriptions in any way limit its scope to any such embodiments and applications, and it will be understood that many substitutions, changes and variations in the described embodiments, applications and details of the method and system illustrated herein and of their operation can be made by those skilled in the art without departing from the spirit of this invention.

We claim:

1. A system for berthing a vessel in unprotected waters, comprising:

(a) a marine structure, attached to the bottom of the sea and provided with loading equipment, said loading equipment configured for attachment to a manifold on said vessel;

(b) at least two floating dolphins, each spaced apart from the other and each moored to the bottom of the sea by relatively soft catenary mooring means or by relatively semi-taut mooring means, said floating dolphins provided with fendering means and placed in closed proximity and in a first fixed spatial relationship and orientation to said marine structure in line with either of the sides of said vessel in said unprotected waters;

(c) positioning means for bringing said vessel alongside in close proximity and in a second fixed spatial relationship and orientation to said marine structure approximately beam on and in line with said fendering means with which said floating dolphins are provided and with the lateral side of the vessel and the fendering means disposed approximately in the same vertical plane; and (d) relatively stiff mooring lines adapted for securing said vessel to said floating dolphins so that said loading equipment may be used to load and unload said vessel, wherein said relative stiff mooring lines are substantially stiff relative to the mooring means.

2. A system for berthing a vessel in unprotected waters, comprising:

(a) a marine structure, attached to the bottom of the sea and provided with loading equipment, said loading equipment configured for attachment to a manifold on said vessel;

(b) at least two floating dolphins, each spaced apart from the other and each moored to the bottom of the sea by relatively soft catenary mooring means or by relatively semi-taut mooring means, each of said floating dolphins comprising a semi-submersible buoyant structure comprising (i) a plurality of buoyant column members, or caissons, arranged in vertical fashion and provided with fendering means attached to said caissons, (ii) a plurality of buoyant hull segments, or pontoons, supporting and separating said caissons and providing heave damping to said buoyant structure, and (iii) a plurality of horizontal bracing members retaining the tops of said caissons in place, said floating dolphins placed in closed proximity and in a first fixed spatial relationship and orientation to said marine structure in line with either of the sides of said vessel in said unprotected waters;

(c) positioning means for bringing said vessel alongside in close proximity and in a second fixed spatial relationship and orientation to said marine structure approximately beam on and in line with said fendering means and with the lateral side of the vessel and the fendering means disposed approximately in the same vertical plane; and (d) relatively stiff mooring lines adapted for securing said vessel to said floating dolphins so that said loading equipment may be used to load and unload said vessel, wherein said relative stiff mooring lines are substantially stiff relative to the mooring means.

3. The berthing system of claim 2, wherein said fendering means attached to said caissons, comprise one or more fenders made of rubber-like impact-absorbing material and so attached to the caissons as to allow each dolphin structure to transfer and absorb the environmental loads resulting from the contacts between each dolphin structure and the vessel.

4. The berthing system of claim 3, wherein solid or liquid ballast material is stored inside said caissons and pontoons in amounts sufficient to establish the desired draft for the floating dolphins.

5. The berthing system of claim 4, wherein said ballast material is seawater.

6. A system for berthing a cargo vessel to a marine port terminal equipped with pivoting loading-and-unloading means in unprotected waters, comprising:

(a) a marine port terminal, attached to the bottom of the sea and provided with pivoting loading-and-unloading means, said pivoting loading-and-unloading means attachable to a manifold on said cargo vessel;

(b) at least two semi-submersible floating dolphins moored to the bottom of the sea by relatively soft catenary mooring means or by relatively semi-taut mooring means, said floating dolphins comprising (i) a plurality of buoyant column members, or caissons, arranged in vertical orientation, (ii) a plurality of buoyant hull segments, or pontoons, supporting and separating said caissons and imparting heave damping to said floating dolphins, and (iii) a plurality of horizontal bracing or deck members retaining the upper portions of said caissons in place, said floating dolphins provided with impact-absorbing fenders attached to said caissons as to allow the floating dolphins to transfer and absorb the environmental loads resulting from the contacts between the floating dolphins and the cargo vessel;

(c) means for placing said floating dolphins in close proximity and in a first fixed spatial relationship and orientation to said marine port terminal in line with either of the sides of said cargo vessel in said unprotected waters;

(d) means for maneuvering said cargo vessel alongside in close proximity and in a second fixed spatial relationship and orientation to said marine port terminal approximately beam on and in line with said impact-absorbing fenders attached to said caissons and with the lateral side of the cargo vessel and the fenders disposed approximately in the same vertical plane; and (e) relatively stiff mooring lines for attaching said cargo vessel to said floating dolphins so that said pivoting loading-and-unloading means may be used to load and unload said cargo vessel to and from said marine port terminal.

7. The berthing system of claim 6, wherein said impact-absorbing fenders attached to said caissons comprise one or more fenders made of rubber-like impact-absorbing material.

8. The berthing system of claim 6, wherein solid or liquid ballast material is stored inside said caissons and pontoons in amounts sufficient to establish the desired draft for the floating dolphins.

9. The berthing system of claim 8, wherein said ballast material is seawater.

10. A method for berthing a vessel in unprotected waters to a marine structure, comprising the steps of:

(a) providing a marine structure attached to the bottom of the sea and provided with loading equipment, said loading equipment configured for attachment to a manifold on said vessel;

(b) providing at least two floating dolphins, each spaced apart from the other and each moored to the bottom of the sea by relatively soft catenary mooring means or by relatively semi-taut mooring means, said floating dolphins provided with fendering means;

(c) placing said floating dolphins in closed proximity and in a first fixed spatial relationship and orientation to said marine structure in line with either of the sides of said vessel in said unprotected waters;

(d) positioning said vessel alongside in close proximity and in a second fixed spatial relationship and orientation to said marine structure approximately beam on and in line with said fendering means with which said floating dolphins are provided and with the lateral side of the vessel and the fendering means disposed approximately in the same vertical plane; and (e) securing said vessel to said floating dolphins by means of relatively stiff mooring lines so that said loading equipment may be used to load and unload said vessel, wherein said relative stiff mooring lines are substantially stiff relative to the mooring means.

11. A method for berthing a vessel in unprotected waters to a marine structure, comprising the steps of:

(a) providing a marine structure attached to the bottom of the sea and provided with loading equipment, said loading equipment configured for attachment to a manifold on said vessel;

(b) providing at least two floating dolphins, each spaced apart from the other and each moored to the bottom of the sea by relatively soft catenary mooring means or by relatively semi-taut mooring means, each of said floating dolphins comprising a semi-submersible buoyant structure comprising (i) a plurality of buoyant column members, or caissons, arranged in vertical fashion and provided with fendering means attached to said caissons, (ii) a plurality of buoyant hull segments, or pontoons, supporting and separating said caissons and providing heave damping to said buoyant structure, and (iii) a plurality of horizontal bracing members retaining the tops of said caissons in place, (c) placing said floating dolphins in closed proximity and in a first fixed spatial relationship and orientation to said marine structure in line with either of the sides of said vessel in said unprotected waters;

(d) positioning said vessel alongside in close proximity and in a second fixed spatial relationship and orientation to said marine structure approximately beam on and in line with said fendering means and with the lateral side of the vessel and the fendering means disposed approximately in the same vertical plane; and (e) securing said vessel to said floating dolphins by means of relatively stiff mooring lines so that said loading equipment may be used to load and unload said vessel, wherein said relative stiff mooring lines are substantially stiff relative to the mooring means.

12. The berthing method of claim 11, wherein said fendering means attached to said caissons comprise one or more fenders made of rubber-like impact-absorbing material and so attached to the caissons as to allow each dolphin to transfer and absorb the environmental loads resulting from the contacts between each dolphin and the vessel.

13. The berthing method of claim 12, wherein solid or liquid ballast material is stored inside said caissons and pontoons in amounts sufficient to establish the desired draft for the floating dolphins.

14. The berthing method of claim 13, wherein said ballast material is seawater.

15. A method for berthing a cargo vessel to a marine port terminal in unprotected waters, comprising the steps of:

(a) providing a marine port terminal attached to the bottom of the sea and equipped with pivoting loading-and-unloading means, said pivoting loading-and-unloading means attachable to a manifold on said cargo vessel;

(b) providing at least two semi-submersible floating dolphins, each spaced apart from the other and each moored to the bottom of the sea by relatively soft catenary mooring means or by relatively semi-taut mooring means, said floating dolphins comprising (i) a plurality of buoyant column members, or caissons, arranged in vertical orientation, (ii) a plurality of buoyant hull segments, or pontoons, supporting and separating said caissons and imparting heave damping to said floating dolphins, and (iii) a plurality of horizontal bracing or deck members retaining the upper portions of said caissons in place, said floating dolphins provided with impact-absorbing fenders attached to said caissons as to allow the floating dolphins to transfer and absorb the environmental loads resulting from the contacts between the floating dolphins and the cargo vessel;

(c) placing said floating dolphins in close proximity and in a first fixed spatial relationship and orientation to said marine port terminal in line with either of the sides of said cargo vessel in said unprotected waters;

(d) maneuvering said cargo vessel alongside in close proximity and in a second fixed spatial relationship and orientation to said marine port terminal approximately beam on and in line with said impact-absorbing fenders attached to said caissons and with the lateral side of the cargo vessel and the fenders disposed approximately in the same vertical plane; and (e) attaching said cargo vessel to said floating dolphins by means of relatively stiff mooring lines so that said pivoting loading-and-unloading means may be used to load and unload said cargo vessel to and from said marine port terminal, wherein said relative stiff mooring lines are substantially stiff relative to the mooring means.

16. The berthing method of claim 15, wherein said impact-absorbing fenders attached to said caissons comprise one or more fenders made of rubber-like impact-absorbing material.

17. The berthing method of claim 15, wherein solid or liquid ballast material is stored inside said caissons and pontoons in amounts sufficient to establish the desired draft for the floating dolphins.

18. The berthing method of claim 17, wherein said ballast material is seawater.

* * * * *